United States Patent [19]

Fariss, Jr.

[11] 4,347,883

[45] Sep. 7, 1982

[54] EASILY REMOVABLE HANDLE MEANS FOR AXES AND THE LIKE

[75] Inventor: James D. Fariss, Jr., Wilmington, Del.

[73] Assignee: Innovation Enterprises, Inc., Wilmington, Del.

[21] Appl. No.: 188,609

[22] Filed: Sep. 19, 1980

[51] Int. Cl.[3] ..... B25G 1/00

[52] U.S. Cl. ..... 145/61 R; 145/2 R; 145/29 R

[58] Field of Search ..... 145/29 R, 29 B, 2 R, 145/61 R

[56] References Cited

U.S. PATENT DOCUMENTS

| | | | |
|---|---|---|---|
| 191,073 | 5/1877 | Roberts | 145/29 R |
| 297,716 | 4/1884 | Rex | 145/2 R |
| 521,861 | 6/1894 | Zeiser et al. | 145/29 R |
| 670,790 | 3/1901 | Leffingwell | 145/2 R |
| 964,976 | 7/1910 | Kukuruda | 145/61 R |

FOREIGN PATENT DOCUMENTS

| | | | |
|---|---|---|---|
| 996400 | 6/1965 | United Kingdom | 145/29 R |

*Primary Examiner*—Jimmy C. Peters
*Assistant Examiner*—J. T. Zatarga
*Attorney, Agent, or Firm*—Mortenson & Uebler

[57] ABSTRACT

An easily removable handle is provided for tools such as axes, mauls, sledges, hatchets, hammers and similar devices. The handle includes a wooden handle with a conventional slot in one end, this end being insertable into the axe or other tool head in the usual way, and apparatus for detachably affixing the handle to the tool head such as, for example, a lag screw extending through the tool head in a direction substantially perpendicular to the axis of the handle, the screw extending through said slot. The screw has a diameter such that, as it passes through the slot, the threads of the screw engage the handle and cause the slot to expand, thereby doubly securing the tool head to the handle.

3 Claims, 6 Drawing Figures

EASILY REMOVABLE HANDLE MEANS FOR AXES AND THE LIKE

BACKGROUND OF THE INVENTION

The invention relates to easily removable wooden handles for cutting and hitting tools such as axes, mauls, sledges, hatchets, hammers and similar devices. Conventional handles for such devices usually have a slot at one end which is insertable into and extends through an opening in the head of the tool in a direction generally parallel to the axe blade or sledge hitting surface. To affix the handle to the tool head, a small wedge is inserted into the slot after placing the handle in the head opening and the wedge is driven into the slot thereby expanding the slot sides and securing the head to the handle.

For anyone who has removed or attempted to remove a handle from an axe or other similar tool head, it is known that this task is formidable and time consuming, and can be unsafe. A handle which has been broken, for example, must be removed and replaced or the tool essentially is useless. Removal has, in the past, been accomplished by brute force using hammers and chisels, and by burning and by other methods.

This invention obviates all of the disadvantages of the prior methods of handle removal and replacement described above, and provides a new and easily removable handle means for such tools.

SUMMARY OF THE INVENTION

Handle means are provided for a tool such as an axe, maul, sledge, hatchet, hammer and the like having a head for cutting or hitting, the handle means including a wooden handle for the head having a slot at one end thereof, this end being insertable into an opening in the head in the conventional way, the opening extending into the head in a direction substantially parallel to the cutting or hitting edge of the head, and means for detachably affixing the handle to the head.

Preferably, the means for detachably affixing the handle to the head include a lag screw type fastener extending into a second opening in the head, this second opening extending from the rear or butt end of the head in a direction substantially perpendicular to the cutting or hitting edge of the head, and oriented such that the lag screw is directed through the slot, the lag screw having a diameter large enough for the screw threads thereof to engage and expand the wooden sides of the slot, thereby doubly securing the tool head to the handle and providing for detachment of head and handle by removing the lag screw.

The lag screw is preferably countersunk into the head so that its top face is flush with the butt end of the head.

DETAILED DESCRIPTION OF THE INVENTION AND PREFERRED EMBODIMENTS WITH REFERENCE TO THE ACCOMPANYING DRAWINGS

An easily removable handle means is provided for tool such as axes, mauls, sledges, hatchets, hammers and similar devices. The handle means of this invention include a wooden handle with a conventional slot in one end, this end being insertable into the axe or other tool head in the usual way, and means for detachably affixing the handle to the tool head such as, for example, a lag screw extending through the tool head in a direction substantially perpendicular to the axis of the handle, the screw extending through said slot. The screw has a diameter such that, as it passes through the slot, the threads of the screw engage the handle and cause to the slot to expand, thereby doubly securing the tool head to the handle.

Figure 1:
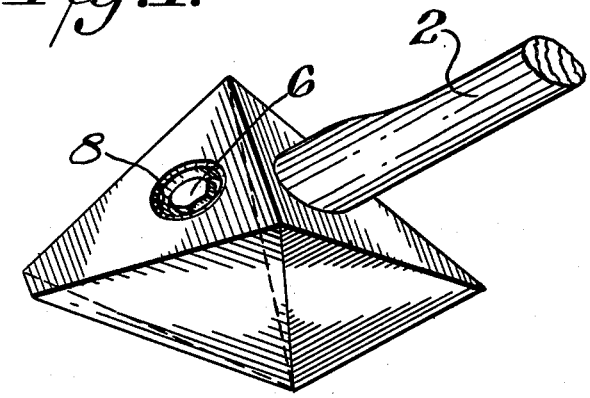
FIG. 1 is a perspective view of the detachable handle means of this invention showing tool head affixed to handle.

A detailed description of the invention can best be given by reference to the accompanying drawings wherein FIG. 1 is a perspective view showing tool head 4 detachably affixed to handle 2 by the preferred means of lag screw 6 countersunk as shown into head 4 in countersink opening 8. In FIGS. 1 through 4, the tool head shown is the geometrically designed tool head disclosed and claimed in my prior U.S. Pat. No. 4,061,168, and this head is preferred, although it will be clear to one skilled in the art that this invention can be used with other heads such as mauls, sledges and the like.

Figure 2:
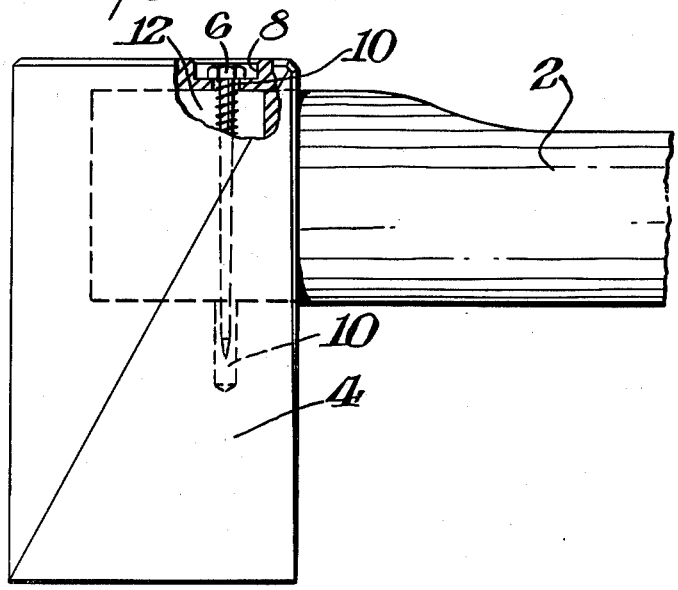
FIG. 2 is a side elevational view of the handle means of this invention, in part broken away and in part cross section, showing preferred means for detachably affixing handle to tool head.

FIG. 2 shows a side elevational view of the invention, in part broken away to expose the detail of the preferred securing means. As shown, handle 2 is inserted into head 4 and is secured thereto by lag bolt 6 inserted into opening 10 in the head 4 and passing through handle 2. This lag bolt is seated in countersunk opening 8 such that the top surface of the bolt head 6 is substantially flush with the rear or butt end of head 4. In this way, the butt end of head 4 can still be used as a hitting tool, as before, with substantially no loss of hitting surface when the removable handle means of this invention is in place.

Figure 3:
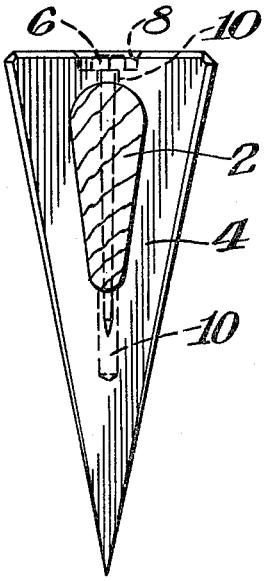
FIG. 3 is a rear end elevation showing handle, tool head and a portion of the detachable handle means.

FIG. 3 shows a rear end view of this invention including handle 2 inserted into head 4 and secured thereto by preferred lag screw 6 countersunk into opening 8 and extending into opening 10 and through the slot in handle 2.

Figure 4:
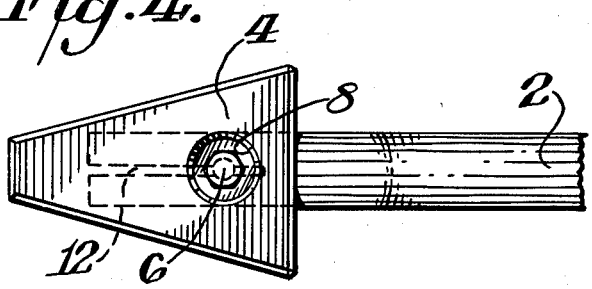
FIG. 4 is a top plan view of the detachable handle means of this invention.

FIG. 4 is a top plan view illustrating the relative positions of preferred lag screw 6, head 4 and handle 2. Handle 2 is inserted into head 4 and lag screw 6 extends downwardly through slot 12 in the end of handle 2. The diameter of screw 6 is such that its threads engage the handle 2 in slot 12 and force both sides of slot 12 apart, thereby doubly securing handle 2 and head 4, first by means of the wedging action of forcing the sides of slot 12 apart, and second by lag screw 6 itself which prevents handle 2 from being pulled from the head 4.

Figure 5:
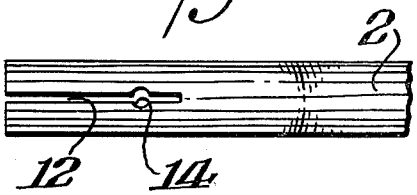
FIG. 5 is a top plan view of the slotted end of the handle insertable into the tool head.

FIG. 5 shows the slotted end of handle 2. Preferably opening 14 is placed in handle 2 and in the slot 12 as shown. The diameter of opening 14 is somewhat smaller than the outer diameter of screw 6. Opening 14 provides a guide means for screw 6 and also provides for engaging and spreading of both sides of slot 12 by screw 6 and securing handle 2 thereby.

Figure 6:
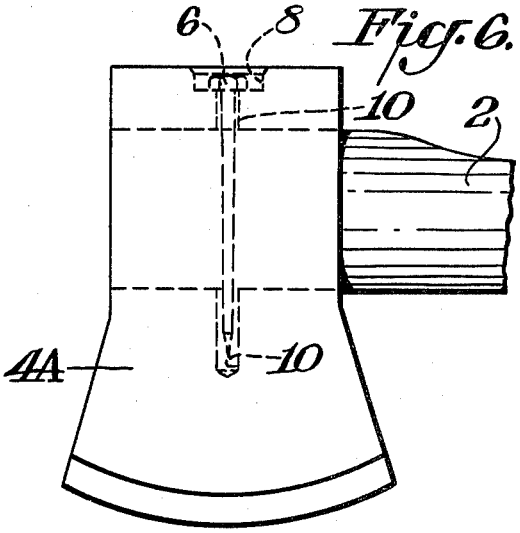
FIG. 6 is a side elevational view of the detachable handle means of this invention used to affix a conventional axe head to a handle.

FIG. 6 shows the detachable handle means of this invention used in conjunction with a conventional axe head. Therein is shown axe head 4A affixed to handle 2 by means of lag screw 6 extending into opening 10 in head 4A and through the slot of handle 2, the screw being countersunk in opening 8.

A lag screw has been described as the preferred fastener for affixing tool head and handle of this invention. However, it will be clear to those skilled in the art that other fasteners can be used without deviating from the gist of the invention or the scope of the claims below. Also, handles other than wooden handles may be used, wood being preferred. In particular, one skilled in the art will know that fiberglas, metal or other similar handle may be used and such handles are deemed to be within the scope of the appended claims.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. A tool such as an axe, maul, sledge, hatchet, hammer and the like comprising:

a head for cutting or hitting, and a wooden handle for said head having a slot at one end thereof, this end being insertable into a first opening extending into said head in a direction substantially parallel to the cutting or hitting edge of said head, and means for detachably affixing said handle to said head comprising a lag screw type fastener extending into a second opening in said head, this second opening extending from the rear or butt end of said head in a direction substantially perpendicular to the cutting or hitting edge of said head, and oriented such that said lag screw is directed through said slot, said lag screw having a diameter large enough for the screw threads thereof to engage and expand the wooden sides of said slot, thereby doubly securing said tool head to said handle and providing for detachment of head and handle by removing the lag screw.

2. The tool of claim 1 wherein the head of said lag screw is countersunk into said tool head such that the top face of said screw head is substantially flush with said rear or butt end of said tool head.

3. The tool of claim 1 wherein an opening is provided in said slot to accomodate and guide said screw fastener therethrough, the diameter of said opening being somewhat smaller than the diameter of said fastener.

* * * * *